US008564221B2

(12) United States Patent
Zhang et al.

(10) Patent No.: US 8,564,221 B2
(45) Date of Patent: Oct. 22, 2013

(54) DRIVING CIRCUIT SYSTEM FOR GAS DISCHARGE LAMP AND THE CONTROL METHOD THEREOF

(75) Inventors: Qi Zhang, Shanghai (CN); Weiqiang Zhang, Shanghai (CN); Jianping Ying, Shanghai (CN)

(73) Assignee: Delta Electronics (Shanghi) Co., Ltd., Shanghai (CN)

( * ) Notice: Subject to any disclaimer, the term of this patent is extended or adjusted under 35 U.S.C. 154(b) by 270 days.

(21) Appl. No.: 13/242,094

(22) Filed: Sep. 23, 2011

(65) Prior Publication Data

US 2013/0026936 A1 Jan. 31, 2013

(30) Foreign Application Priority Data

Jul. 26, 2011 (CN) ..... 2011 1 0212391

(51) Int. Cl.
*G05F 1/00* (2006.01)

(52) U.S. Cl.
USPC ..... 315/291; 315/307; 315/224; 315/247; 315/274

(58) Field of Classification Search
USPC ..... 315/247, 224, 209 R, 291, 307–311
See application file for complete search history.

(56) References Cited

U.S. PATENT DOCUMENTS

2008/0297069 A1* 12/2008 Shao et al. ..... 315/307
2010/0134048 A1* 6/2010 Pancani et al. ..... 315/307
2011/0227497 A1* 9/2011 Hu et al. ..... 315/224

* cited by examiner

*Primary Examiner* — Tuyet Thi Vo
(74) *Attorney, Agent, or Firm* — Kirton McConkie; Evan R. Witt

(57) ABSTRACT

A driving circuit system for a gas discharge lamp includes a power circuit having a switch for converting an input voltage into a lamp voltage for driving the gas discharge lamp, a lamp current detecting circuit connected to the power circuit or the gas discharge lamp for detecting a lamp current, a feedback circuit connected to the lamp current detecting circuit for generating a lamp current feedback signal, a constant power control circuit for generating a corrected current reference signal, and a power control circuit connected to the feedback circuit, the constant power control circuit, and the switch of the power circuit for generating a first modulating signal in accordance with the lamp current feedback signal and the corrected current reference signal for driving the switch to turn on or off, thereby substantially maintaining a lamp power of the gas discharge lamp at a constant value.

20 Claims, 7 Drawing Sheets

DRIVING CIRCUIT SYSTEM FOR GAS DISCHARGE LAMP AND THE CONTROL METHOD THEREOF

FIELD OF THE INVENTION

The invention relates to a driving circuit system, and more particularly to a driving circuit system for gas discharge lamp and the control method thereof.

BACKGROUND OF THE INVENTION

High-intensity discharge (HID) lamps are used as a light source which uses gas discharging principle to achieve illumination. As the HID lamp has a high luminance, large illumination area, and low power consumption, the HID lamp has been widely employed to illuminate a large open space or provide illumination for automobiles.

Referring to FIG. 1, the relationship of the lamp power versus the lamp voltage of the HID lamp according to the prior art is shown. As shown in FIG. 1, after the HID lamp ignited, the driving circuit for HID lamp outputs a constant current to heat the lamp electrodes. Thus, the lamp power and the lamp voltage of the HID lamp will rise gradually. When the lamp voltage rises continuously to exceed the switching voltage Vs under the constant power control mode, the lamp power outputted from the driving circuit for HID lamp will stop rising and maintain at a constant value. In the meantime, the lamp voltage will rise to a stable value gradually. Each time the HID lamp is ignited, the lamp voltage under the stable mode will rise continuously in accordance with the accumulated service time of the HID lamp. The rising of the lamp voltage under the stable mode will last until the burnout of the HID lamp. Generally, the driving circuit for HID lamp for conventional HID lamp (not shown) controls the lamp power directly through the lamp voltage and the lamp current. Nonetheless, in some applications the lamp voltage and the lamp current are difficult to be detected directly. Therefore, the control of the lamp power requires to be implemented in an indirect way. This would cause a problem of how to precisely control the lamp power of HID lamp.

The contemporary driving circuit for HID lamp accomplishes the lamp power control by providing a constant reference voltage. The principle of control is to compare a feedback signal generated by a feedback circuit with the constant reference voltage and generate an error signal in response to the comparison. The duty ratio or the switching frequency of the switch elements in the driving circuit for HID lamp is adjusted in accordance with the variations of the error signal, thereby maintaining the lamp power at a constant value. Due to the lamp's has negative impedance during its operation phase, the lamp voltage of the HID lamp is determined by the lamp current and the impedance of the HID lamp during the discharging operation as the HID lamp is operating under the constant power control mode. Therefore, the driving circuit for HID lamp is set to achieve constant power control by adjusting the lamp current.

Nevertheless, as the HID lamp has been used for a long haul and starts to age, the required lamp voltage to be applied to the lamp electrodes of the HID lamp will vary. Generally, the required lamp voltage to be applied to the lamp electrodes of the HID lamp is higher during the initial stage of the service term of the HID lamp. Therefore, if the aged HID lamp is driven by providing the required lamp voltage used in the initial stage of the service term of the HID lamp, the lamp power will be extraordinarily high and the lifetime of the HID lamp will be shortened.

Therefore, there is an urgent need to develop a driving circuit for HID lamp that can address the aforementioned problems.

SUMMARY OF THE INVENTION

The primary object of the invention is to provide a driving circuit system for gas discharge lamp and the control method thereof for maintaining the lamp power of a gas discharge lamp at a constant value regardless of the age of the gas discharge lamp, thereby preventing the lifetime of the gas discharge lamp from being shortened.

To this end, a broad aspect of the invention is accomplished by the provision of a driving circuit system for gas discharge lamp, including a power circuit having a first switch for converting an input voltage into a lamp voltage for driving a gas discharge lamp in accordance with switching operations of the first switch; a lamp current detecting circuit connected to the power circuit or the gas discharge lamp for detecting a lamp current of the gas discharge lamp; a feedback circuit connected to the lamp current detecting circuit for generating a lamp current feedback signal in accordance with variations of the lamp current; a constant power control circuit for generating a corrected current reference signal in accordance with a status of the gas discharge lamp; and a power control circuit connected to the feedback circuit, the constant power control circuit, and the first switch of the power circuit for generating a first modulating signal in accordance with the lamp current feedback signal and the corrected current reference signal for driving the first switch to turn on or off, thereby substantially maintaining a lamp power of the gas discharge lamp at a constant value.

Another broad aspect of the invention is accomplished by the provision of a driving circuit system for gas discharge lamp, including an inverter having a second switch and a third switch for converting a DC voltage into a lamp voltage for driving a gas discharge lamp in accordance with switching operations of the second switch and the third switch; a lamp current detecting circuit connected to the inverter or the gas discharge lamp for detecting a lamp current of the gas discharge lamp; a feedback circuit connected to the lamp current detecting circuit for generating a lamp current feedback signal in accordance with variations of the lamp current; a constant power control circuit for generating a corrected current reference signal in accordance with a status of the gas discharge lamp; a power control circuit for generating a second modulating signal and a third modulating signal in accordance with the lamp current feedback signal and the corrected current reference signal; and a switching driver connected to a control terminal of the second switch and a control terminal of the third switch for receiving the second modulating signal and the third modulating signal to drive the second switch and the third switch to turn on or off, thereby substantially maintaining a lamp power of the gas discharge lamp at a constant value.

Another broad aspect of the invention is accomplished by the provision of a control method for controlling a driving circuit system for gas discharge lamp, comprising the steps of: (1) detecting a signal associated with a lamp current of a gas discharge lamp and in response thereto generating a first current detecting signal associated with the lamp current; (2) generating a lamp current feedback signal in accordance with the first current detecting signal; (3) generating a corrected current reference signal in accordance with a status of the gas discharge lamp; and (4) generating a first modulating signal in accordance with the lamp current feedback signal and the corrected current reference signal, thereby driving a first switch of a power circuit to turn on or off and substantially maintaining a lamp power of the gas discharge lamp at a constant value.

Now the foregoing and other features and advantages of the invention will be best understood through the following descriptions with reference to the accompanying drawings, in which:

DESCRIPTION OF THE PREFERRED EMBODIMENT

Several exemplary embodiments embodying the features and advantages of the invention will be expounded in following paragraphs of descriptions. It is to be realized that the present invention is allowed to have various modification in different respects, all of which are without departing from the scope of the present invention, and the description herein and the drawings are to be taken as illustrative in nature, but not to be taken as a confinement for the invention.

Figure 1:
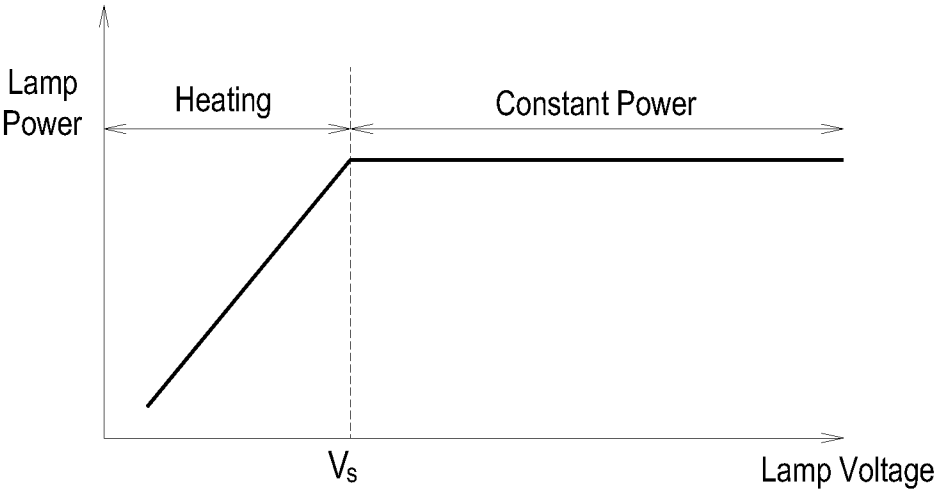
FIG. 1 (PRIOR ART)
FIG. 1 shows the relationship of the lamp power versus the lamp voltage of the HID lamp according to the prior art.
Figure 2:
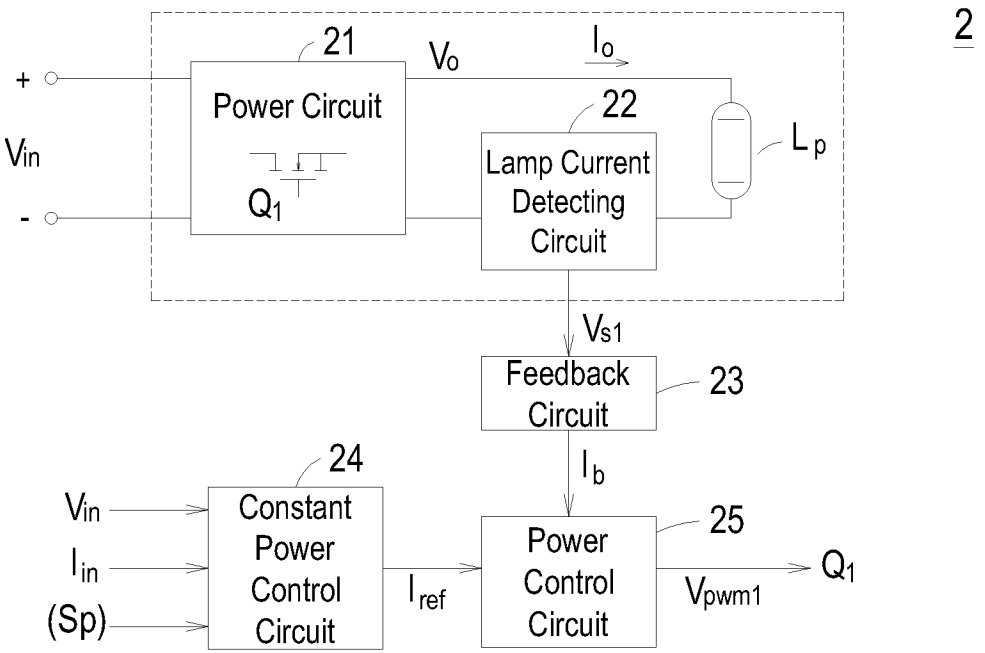
FIG. 2 is a block diagram of the driving circuit system for gas discharge lamp according to the invention.

Referring to FIG. 2, a block diagram of the driving circuit system for gas discharge lamp according to the invention is shown. As shown in FIG. 2, the driving circuit system 2 for gas discharge lamp includes a power circuit 21, a gas discharge lamp Lp, a lamp current detecting circuit 22, a feedback circuit 23, a constant power control circuit 24, and a power control circuit 25. The power circuit 21 includes at least one first switch Q1 for converting the input voltage Vin into a lamp voltage Vo through the operation of the first switch Q1, thereby driving the gas discharge lamp Lp. The lamp current detecting circuit 22 is connected to the power circuit 21 or the gas discharge lamp Lp for detecting the lamp current Io of the gas discharge lamp Lp. The feedback circuit 23 is connected to the lamp current detecting circuit 22 for generating a lamp current feedback signal Ib in accordance with the variations of the lamp current Io. The constant power control circuit 24 is use to receive the input voltage Vin, the input current Iin, and a signal SP associated with the lamp voltage (such as the lamp voltage Vo or the duty ratio of the first switch Q1) for determining the status of the gas discharge lamp Lp and generating a current reference signal Iref in accordance with the status of the gas discharge lamp Lp. The power control circuit 25 is connected to the feedback circuit 23, the constant power control circuit 24, and the first switch Q1 of the power circuit 21 for generating a first modulating signal Vpwm1 in accordance with the lamp current feedback signal Ib and the current reference signal Iref, thereby driving the first switch Q1 to turn on or off.

As the gas discharge lamp Lp is ignited and enters the stable mode, the driving circuit system 2 is set to operate under the constant power mode. The lamp current detecting circuit 22, the power control circuit 25, and the first switch Q1 of the power circuit 21 constitute a closed loop for controlling the lamp current Io. The lamp voltage Vo can be determined by the lamp current and the lamp impedance. Therefore, the output power can be controlled by controlling the lamp current Io. In other words, the constant power control circuit 24 can substantially control the lamp power Plamp at a constant value by regulating the lamp reference signal Iref. The constant power control circuit 24 and the power control circuit 25 can be implemented by analog circuits or digital circuits.

Figure 3:
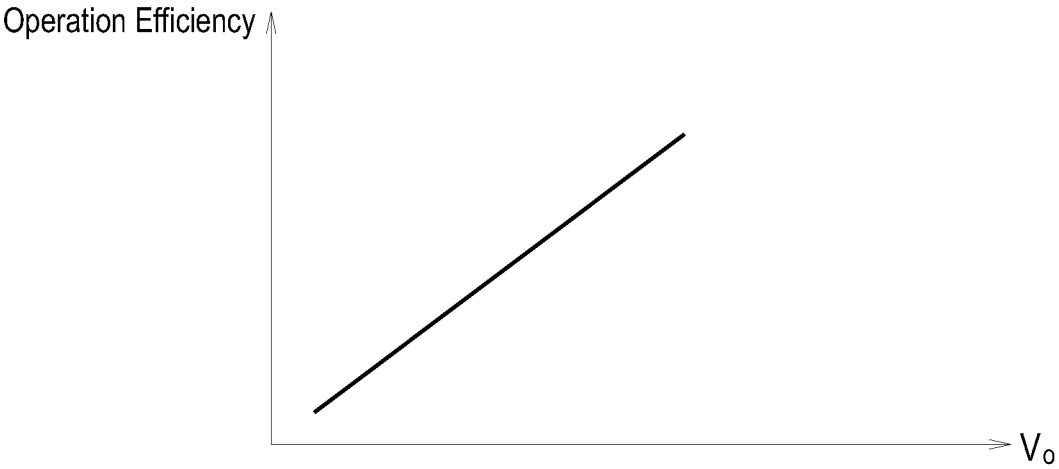
FIG. 3 is shows the relationship of the operation efficiency of the driving circuit system versus the lamp voltage of the gas discharge lamp according to the invention.

Referring to FIG. 3, the relationship of the operation efficiency of the driving circuit system versus the lamp voltage of the gas discharge lamp according to the invention is shown. As shown in FIG. 3, the operation efficiency η of the driving circuit system 2 is increased along with the increase of the lamp voltage Vo. The relationship between the operation efficiency η and the lamp voltage Vo is non-linear. In this embodiment, the relationship between the operation efficiency η and the lamp voltage Vo is represented in a linear fashion for the simplicity of calculation and control. The lamp power Plamp outputted from the driving circuit system 2 to the gas discharge lamp Lp can be calculated by the input power Pin and the operation efficiency η. The lamp power Plamp can be calculated by the following equation:

$$Plamp=Pin\times\eta=Vin\times Iin\times\eta(Vo) \quad (1\text{-}1)$$

Where the lamp voltage Vo is the product of the duty ratio D and the input voltage Vin if the driving circuit system 2 is configured as a buck circuit. In such case, the operation efficiency η is a function of the duty ratio D and the input voltage Vin. Thus, the equation (1-1) can be reformed as the following equation:

$$Plamp=Vin\times Iin\times\eta(D,Vin) \quad (1\text{-}2)$$

In case that the variation of the input voltage Vin is small, the influence of the input voltage Vin on the lamp power Plamp can be ignored. The formula of the lamp power Plamp can be approximated to a function of the duty ratio as:

$$Plamp=Vin\times Iin\times\eta(D) \quad (1\text{-}3)$$

It can be understood from the above descriptions that the lamp power Plamp can be calculated by means of either one of the following two approaches: (1) detecting the input voltage Vin, the input current Iin, and the lamp voltage Vo, and calculating the lamp power Plamp by the equation (1-1); or (2) detecting the input voltage Vin, the input current Iin, and duty ratio D, and calculating the lamp power Plamp by the equation (1-2) or the equation of (1-3). In other words, the constant power control circuit 24 can receive the input voltage Vin, the input current Iin, the duty ratio D of the first modulating signal Vpwm1, the lamp current Io, the lamp voltage Vo, and/or the combination of them to determine the status of the gas discharge lamp Lp and perform the constant power control for the gas discharge lamp.

Figure 4:
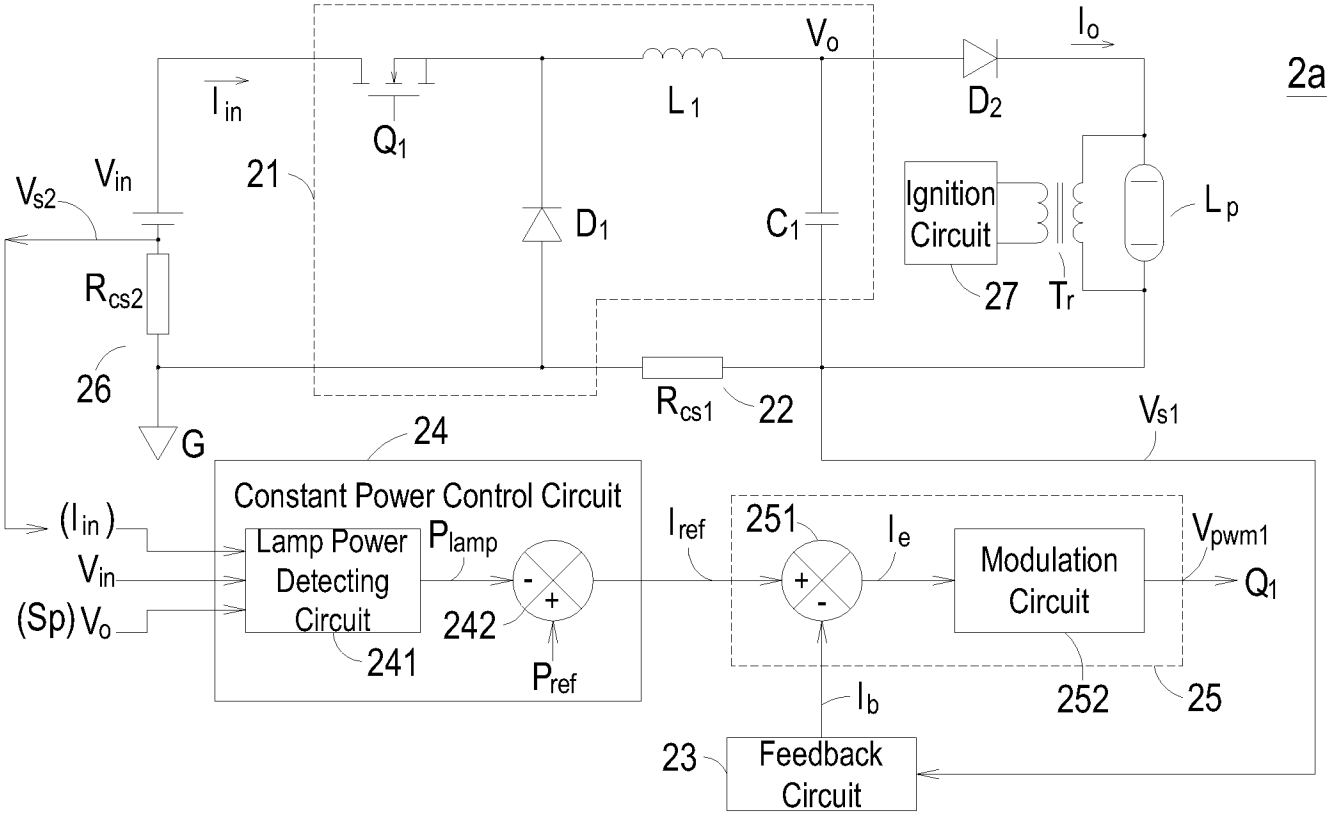
FIG. 4 shows the detailed circuitry of the driving circuit system for gas discharge lamp according to a first embodiment of the invention.

Referring to FIG. 4, the detailed circuitry of the driving circuit system for gas discharge lamp according to a first embodiment of the invention is shown. In this embodiment, the driving circuit system 2*a* for gas discharge lamp includes a power circuit 21, a gas discharge lamp Lp, a lamp current detecting circuit 22, a feedback circuit 23, a constant power control circuit 24, and a power control circuit 25. As shown in FIG. 4, the constant power control circuit 24 includes a lamp power detecting circuit 241 and a power error amplifier 242. In operation, the lamp power detecting circuit 241 calculates the current lamp power Plamp. Afterwards, the power error amplifier 242 corrects the current reference signal Iref in accordance with the error between the current lamp power Plamp and the predetermined power Pref. Thus, the constant power control circuit 24 can maintain the lamp power Plamp at a constant value by correcting the current reference signal Iref. In this embodiment, the lamp power detecting circuit 241 may obtain the input voltage Vin, the input current Iin, and the lamp voltage Vo and calculate the lamp power Plamp using the equation (1-1). The power control circuit 25 may be implemented as a power controller. The operation principle of the power control circuit 25 is to allow the current error amplifier 251 of the power control circuit 25 to compare the current reference signal Iref with the lamp current feedback signal Ib which is variable with the lamp current Io and generate a current error signal Ie in response to the comparison, and then allow the modulation circuit 252 of the power control circuit 25 to adjust the duty ratio or the switching frequency of the first modulating signal Vpwm1 in accordance with the current error signal Ie. In this way, the lamp current feedback signal Ib is equal to the current reference signal Iref. In this embodiment, the modulation circuit 252 can be a pulse width modulator (PWM) or a frequency modulator, and can adjust the duty ratio D or the switching frequency of the first modulating signal Vpwm1 in accordance with the current error signal Ie which is the difference between the lamp current feedback signal Ib and the current reference signal Iref.

Unlike to the prior art, the current reference signal Iref of the invention is not fixed but is variable with the status of the gas discharge lamp Lp. Thus, as the gas discharge lamp Lp is aged, the constant power control circuit 24 can correct the current reference signal Iref and substantially maintain the lamp power Plamp of the gas discharge lamp Lp at a constant value.

In this embodiment, the power circuit 21 can be an isolated converter or a non-isolated converter. Also, the power circuit 21 can be a buck converter or a boost converter. Also, the power circuit 21 can be a PWM converter or a resonant converter. In this embodiment, the power circuit 21 is a buck converter. The power circuit 21 includes a first inductor L1, a first capacitor C1, a first diode D1, and a first switch Q1. In this embodiment, the driving circuit system 2 for gas discharge lamp further optionally includes a second diode D2 connected between the output side of the power circuit 21 and the gas discharge lamp Lp. One end of the first switch and one end of the first inductor L1 are connected to the cathode of the first diode D1. The anode of the first diode D1 is connected to ground G. The anode of the second diode D2 and the other end of the first inductor L1 are connected to one end of the first capacitor C1. The cathode of the second diode D2 and the other end of the first capacitor C1 are respectively connected to one end of the gas discharge lamp Lp. The control terminal of the first switch Q1 is connected to the output of the power control circuit 25. The other end of the first switch Q1 is set to receive the input voltage Vin. When the first switch Q1 is turned on in response to the first modulating signal Vpwm1, the input current Iin flows to the power circuit 21 through the first switch Q1.

In this embodiment, the lamp current detecting circuit 22 may be a first current detecting resistor Rcs1 that is connected between the ground G and the gas discharge lamp Lp. The first current detecting resistor Rcs1 and the output side of the power circuit 21 constitute a series loop. In operation, as the average value of the current flowing through the first capacitor C1 is zero, the average value of the lamp current Io flowing through the gas discharge lamp Lp is equal to the average value of the current flowing through the first current detecting resistor Rcs1. Hence, the average value of the lamp current Io of the gas discharge lamp Lp can be obtained by detecting the average value of the current of the first current detecting resistor Rcs1. A first current detecting signal Vs1 is generated as the lamp current Io is flowing through the first current detecting resistor Rcs1, and thus the feedback circuit can generate a lamp current feedback signal Ib in accordance with the first current detecting signal Vs1 which is associated with the lamp current Io.

In this embodiment, the driving circuit system 2*a* for gas discharge lamp further includes an input current detecting circuit 26, an ignition circuit 27, and an isolated transformer Tr. The input current detecting circuit 26 may be a second current detecting resistor Rcs2, and forms a series loop with the input side of the driving circuit system 2*a*. The input current detecting circuit 26 is used to detect the input current Iin. In operation, the input current Iin flows through the second current detecting resistor Rcs2 and thus a second current detecting signal Vs2 is generated on the second current detecting resistor Rcs2. The lamp power detecting circuit 241 of the constant power control circuit 24 can obtain the input current Iin in accordance with the second current detecting signal Vs2 associated with the input current Iin, and can calculate the lamp power Plamp by the equation (1-1) in accordance with the input voltage Vin and the output lamp voltage Vo. The primary winding of the isolated transformer Tr is connected to the ignition circuit 27, and the secondary winding of the isolated transformer Tr is connected across the gas discharge lamp Lp. Before the gas discharge lamp is ignited, the high igniting voltage generated by the ignition circuit 27 is transmitted to both ends of the gas discharge lamp Lp through the isolated transformer Tr, thereby exciting the gas discharge lamp Lp to illuminate. Afterwards, after the gas discharge lamp Lp is ignited, the ignition circuit 27 stops operating. The impedance of the gas discharge lap Lp becomes a stable value after the lamp electrodes of the gas discharge lamp Lp has been heated for a predetermined period of time. Under this condition, the driving circuit system 2*a* operates under the constant power mode and outputs a constant lamp power Plamp to the gas discharge lamp Lp, thereby allowing the gas discharge lamp Lp to illuminate continuously.

In this embodiment, the high igniting voltage generated by the ignition circuit 27 is transmitted to both ends of the gas discharge lamp Lp to excite the gas discharge lamp Lp. The second diode D2 of the driving circuit system 2*a* can prevent the high igniting voltage generated by the ignition from damaging the internal components of the driving circuit system 2*a*. In alternative embodiments, the driving circuit system 2*a* can optionally eliminate the second diode D2, i.e. the first inductor L1 located at the input side of the power circuit 21 is directly connected to the gas discharge lamp Lp.

Figure 5:
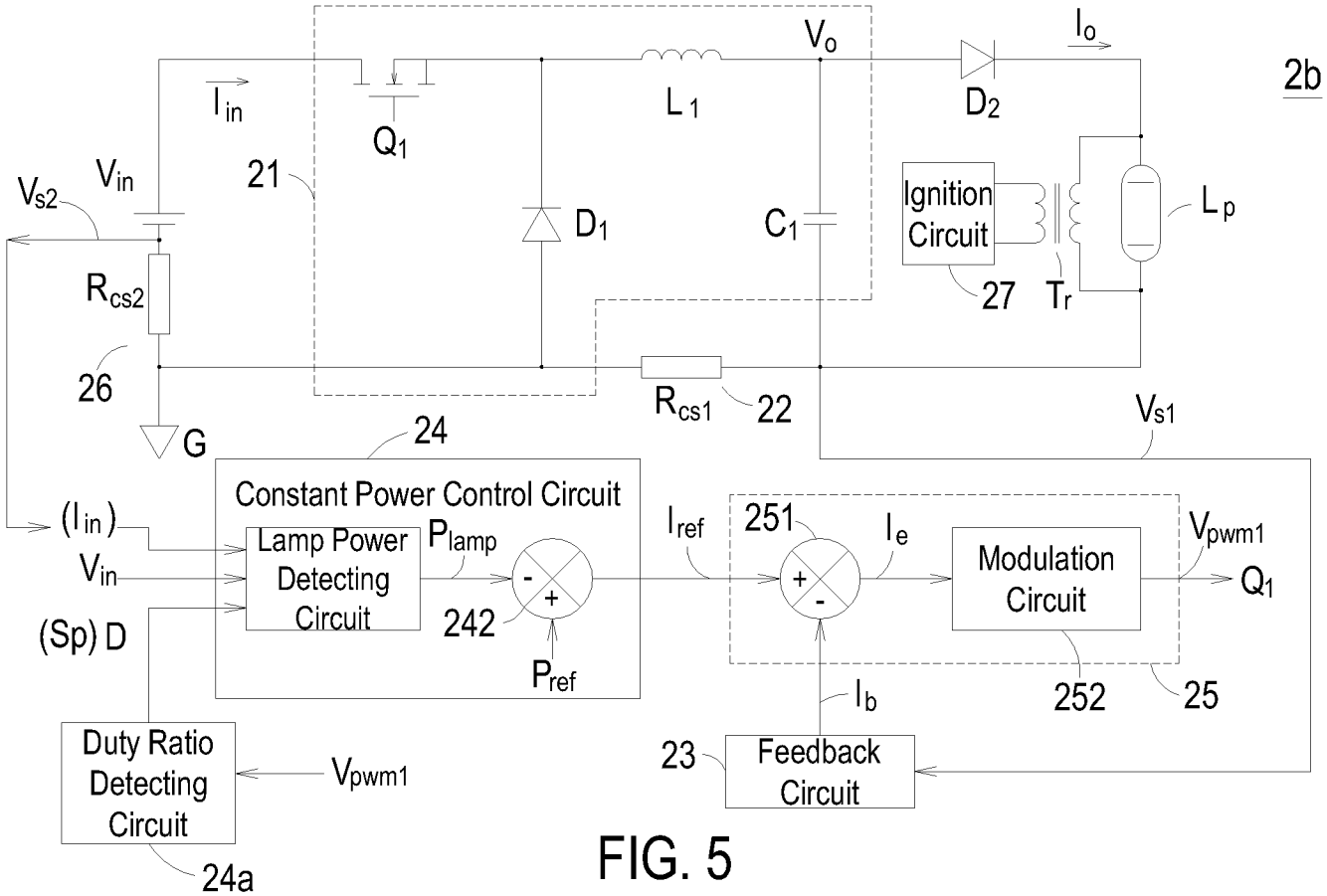
FIG. 5 shows the detailed circuitry of the driving circuit system for gas discharge lamp according to a second embodiment of the invention.

Referring to FIG. 5 and FIG. 4, in which FIG. 5 is a detailed circuit diagram showing the driving circuit system for gas discharge lamp according to a second embodiment of the invention. The difference between FIG. 4 and FIG. 5 is that the driving circuit system 2*b* of FIG. 5 further includes a duty ratio detecting circuit 24*a*, and the lamp power detecting circuit 241 uses the equation (1-2) or the equation (1-3) to calculate the lamp power Plamp in accordance with the input voltage Vin, the input current Iin, and the duty ratio D of the first modulating signal Vpwm1 of the first switch Q1. It is to be noted that similar elements bear the same reference numerals throughout the specification. The duty ratio D generated by the duty ratio detecting circuit 24*a* can be obtained by the digital controller or micro-controller unit.

Figure 6:
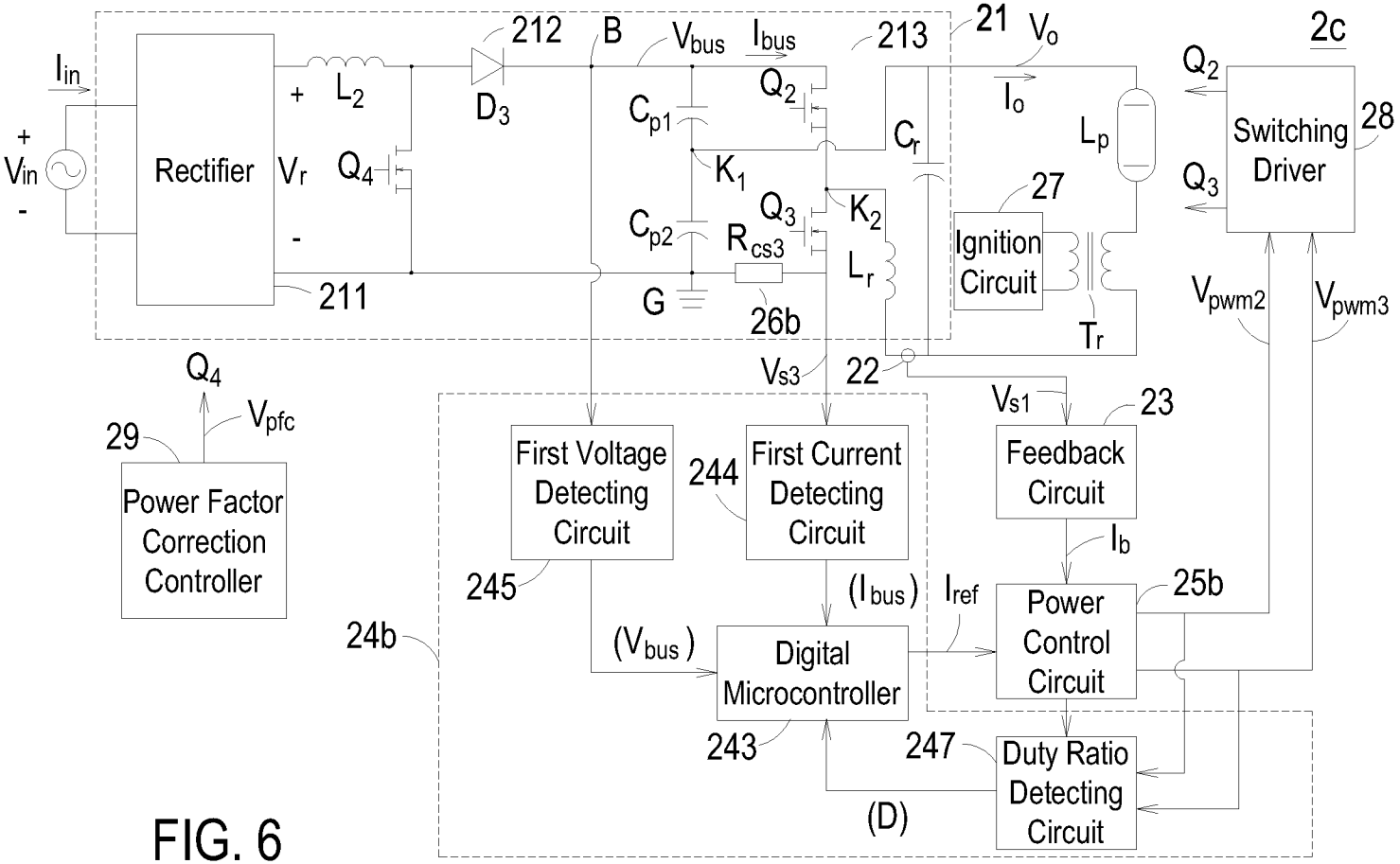
FIG. 6 shows the detailed circuitry of the driving circuit system for gas discharge lamp according to a third embodiment of the invention.

Referring to FIG. 6 and FIG. 4, in which FIG. 6 is a detailed circuit diagram showing the driving circuit system for gas discharge lamp according to a third embodiment of the invention. As shown in FIG. 6, the driving circuit system 2*c* for gas discharge lamp additionally includes a switching driver 28 and a power factor correction controller 29. The difference between FIG. 6 and FIG. 4 is that the power factor circuit 21 of FIG. 6 includes a rectifier 211, a power factor correction circuit 212, and an inverter 213 that are connected with each other in sequence. In operation, the rectifier 211 rectifies the input voltage Vin into a full-wave rectified voltage Vr, and this full-wave rectified voltage Vr is boosted by the power factor correction circuit 212 so as to generate a high bus voltage Vbus with a corrected power factor. The voltage value of the bus voltage Vbus could be, for example, 400V. Finally, the inverter 213 converts the bus voltage Vbus into an AC lamp voltage Vo.

In this embodiment, the rectifier 211 may a bridge rectifier. The AC input side of the rectifier 211 is used to receive the input voltage Vin and generate a full-wave rectified voltage at its DC output side. The power factor correction circuit 212 includes a second inductor L2, a third diode D3, and a fourth switch Q4. One end of the second inductor L2, the anode of the third diode D3, and one end of the fourth switch Q4 are connected with each other. The cathode of the third diode D3 is connected to the bus B. The other end of the second inductor L2 is connected to the positive output terminal of the rectifier 211. The other end of the fourth switch Q4 is connected to the negative output terminal of the rectifier 211. The control terminal of the fourth switch Q4 is connected to the power factor correction controller 29. In operation, the power factor correction controller 29 outputs a power factor control signal Vpfc to the output terminal of the fourth switch Q4 so as to allow the fourth switch Q4 to turn on or off in accordance with the power factor control signal Vpfc. Therefore, the waveform of the input current Iin is analogous to the sinusoidal waveform of the input voltage Vin, and the power factor of the input voltage Vin is boosted accordingly.

The inverter 213 may be a full-bridge converter or a half-bridge converter. Also, the inverter 213 may be a PWM converter or a resonant converter. In case the inverter 213 is a resonant converter, the inverter 213 may be a parallel resonant converter or a series resonant converter. In this embodiment, the inverter 213 is a half-bridge PWM converter, including a first voltage-dividing capacitor Cp1, a second voltage-dividing capacitor Cp2, a second switch Q2, a third switch Q3, and a filter consisted of a filtering capacitor Cr and a filtering inductor Lr. The first voltage-dividing capacitor Cp1 and the second voltage-dividing capacitor Cp2 are connected in series with each other at a first connecting node K1 and form a voltage-dividing circuit. This voltage-dividing circuit is connected between the bus B and the ground G and generates a fractional voltage at the first connecting node K1 whose voltage value is half of the bus voltage Vbus. The second switch Q2 and the third switch Q3 are connected in series with each other at a second connecting node K2 and form a switch circuit. This switch circuit is connected to the voltage-dividing circuit at the bus B. The control terminal of the second switch Q2 and the control terminal of the third switch Q3 are respectively connected to the switching driver 28, and are driven by the switching driver 28 to allow the second switch Q2 and the third switch Q3 to turn on or off in accordance with the second modulating signal Vpwm2 and the third modulating signal Vpwm3, respectively. When the second switch Q2 is turned on in accordance with the second modulating signal Vpwm2, the bus current Ibus will be transmitted to the filtering inductor Lr, the filtering capacitor Cr, and the lamp circuit through the second switch Q2, thereby generating a positive voltage at the second connecting node K2 and the first connecting node K1. Otherwise, when the third switch Q3 is turned on in accordance with the third modulating signal Vpwm3, the bus current Ibus will be transmitted to the third switch Q3 through the filtering inductor Lr, the filtering capacitor Cr, and the lamp circuit, thereby generating a negative voltage at the second connecting node K2 and the first connecting node K1.

As the average current flowing through the filtering capacitor Cr is zero, the average current flowing through the filtering inductor Lr and the average value of the lamp current Io flowing through the gas discharge lamp Lp are the same. Hence, the average value of the lamp current Io of the gas discharge lamp Lp can be obtained by calculating the average current of the filtering inductor Lr. In this embodiment, the average value of the lamp current Io of the gas discharge lamp Lp is detected by calculating the average current of the filtering inductor Lr. In this embodiment, the lamp current detecting circuit 22 may be a current transformer. In operation, the current of the filtering inductor Lr flows through the lamp current detecting circuit 22 and the first current detecting signal Vs1 associated with the lamp current Io is generated accordingly. Therefore, the feedback circuit 23 can generate a lamp current feedback signal Ib associated with the lamp current Io in accordance with the first current detecting signal Vs1.

In this embodiment, the power control circuit 25*b* is connected to the feedback circuit 23, the constant power control circuit 24*b*, and the switching driver 28 for generating the second modulating signal Vpwm2 and the third modulating signal Vpwm3 in accordance with the lamp current feedback signal Ib and the current reference signal Iref, thereby allowing the second switch Q2 and the third switch Q3 to turn on or off. In other words, the inverter 213 can output AC lamp voltage Vo to the gas discharge lamp Lp by means of the alternate switching operation of the second switch Q2 and the third switch Q3.

In this embodiment, the driving circuit system 2*c* further includes a bus current detecting circuit 26*b* that may be a third current-detecting resistor Rcs3 and is connected to the input end of the inverter 213 to constitute a series loop with the output end of the input end of the inverter 213. The bus current detecting circuit 26*b* is used to detect bus current Ibus. In operation, the bus current Ibus flows through the third current-detecting resistor Rcs3 to generate a third current detecting signal Vs3, thereby allowing the digital microcontroller 243 of the constant power control circuit 24*b* to obtain the current bus current Ibus through the first current detecting circuit 244.

In this embodiment, when the electric energy is transmitted to the gas discharge lamp Lp through the power circuit 21, the electric energy will pass through the rectifier 211, the power factor correction circuit 212, and the inverter 213. If it is intended to observe the operation of the driving circuit system form the viewpoint of the energy conversion efficiency instead of the whole power circuit 21, the lamp power Plamp can be calculated by means of the operation efficiency η of the inverter 213, the duty ratio of the inverter 213, the bus voltage Vbus inputtd to the inverter 213, the bus current Ibus inputted to the inverter 213, and/or the combination of them. This would determine the status of the gas discharge lamp Lp. The equation for calculating the lamp power Plamp can be reformulated as follows:

$$Plamp = Vbus \times Ibus \times \eta(Vo) \quad (2\text{-}1)$$

$$Plamp = Vbus \times Ibus \times \eta(D, Vo) \quad (2\text{-}2)$$

$$Plamp = Vbus \times Ibus \times \eta(D) \quad (2\text{-}3)$$

Likewise, the lamp power Plamp can be calculated by means of either one of the following two approaches: (1) detecting the bus voltage Vbus, the bus current Ibus, and the lamp voltage Vo, and calculating the lamp power Plamp by the equation (2-1); or (2) detecting the bus voltage Vbus, the bus current Ibus, and the duty ratio D of the inverter 213, and calculating the lamp power Plamp by the equation (2-2) or the equation of (2-3).

In this embodiment, the constant power control circuit 24*b* includes a digital microcontroller 243, a first voltage detecting circuit 245, a first current detecting circuit 244, and a duty ratio detecting circuit 247. The digital microcontroller 243 can calculate the lamp power Plamp by means of the duty ratio D of the second modulating signal Vpwm2 and the duty ratio of the third modulating signal Vpwm3, the bus voltage Vbus, the bus current Ibus, and/or the combination of them, thereby determining the status of the gas discharge lamp Lp and outputting the current reference signal Iref to the power control circuit 25*b*. In this embodiment, the first voltage detecting circuit 245, the first current detecting circuit 244, and the duty ratio detecting circuit 247 are respectively connected to the bus B, the bus current detecting current 26*b*, and the power control circuit 25*b* in addition to the digital microcontroller 243, so that the digital microcontroller 243 can acquire the bus voltage Vbus, the bus current Ibus, and the duty ratio D by the first voltage detecting circuit 245, the first current detecting circuit 244, and the duty ratio detecting circuit 247. Thus, the status of the gas discharge lamp Lp is determined and a corrected current reference signal Iref is outputted to the power control circuit 25*b*.

In this embodiment, the driving circuit system 2*c* further includes an ignition circuit 27 and an isolated transformer Tr, in which the isolated transformer Tr has a primary winding connected to the ignition circuit 27 and a secondary winding connected to one end of the gas discharge lamp Lp. The secondary winding of the isolated transformer Tr and the gas discharge lamp LP form a series circuit. Before the gas discharge lamp Lp is ignited, the high igniting voltage generated by the ignition circuit 27 is transmitted to the gas discharge lamp Lp through the isolated transformer Tr and the filtering capacitor Cr, thereby exciting the gas discharge lamp Lp.

Figure 7:
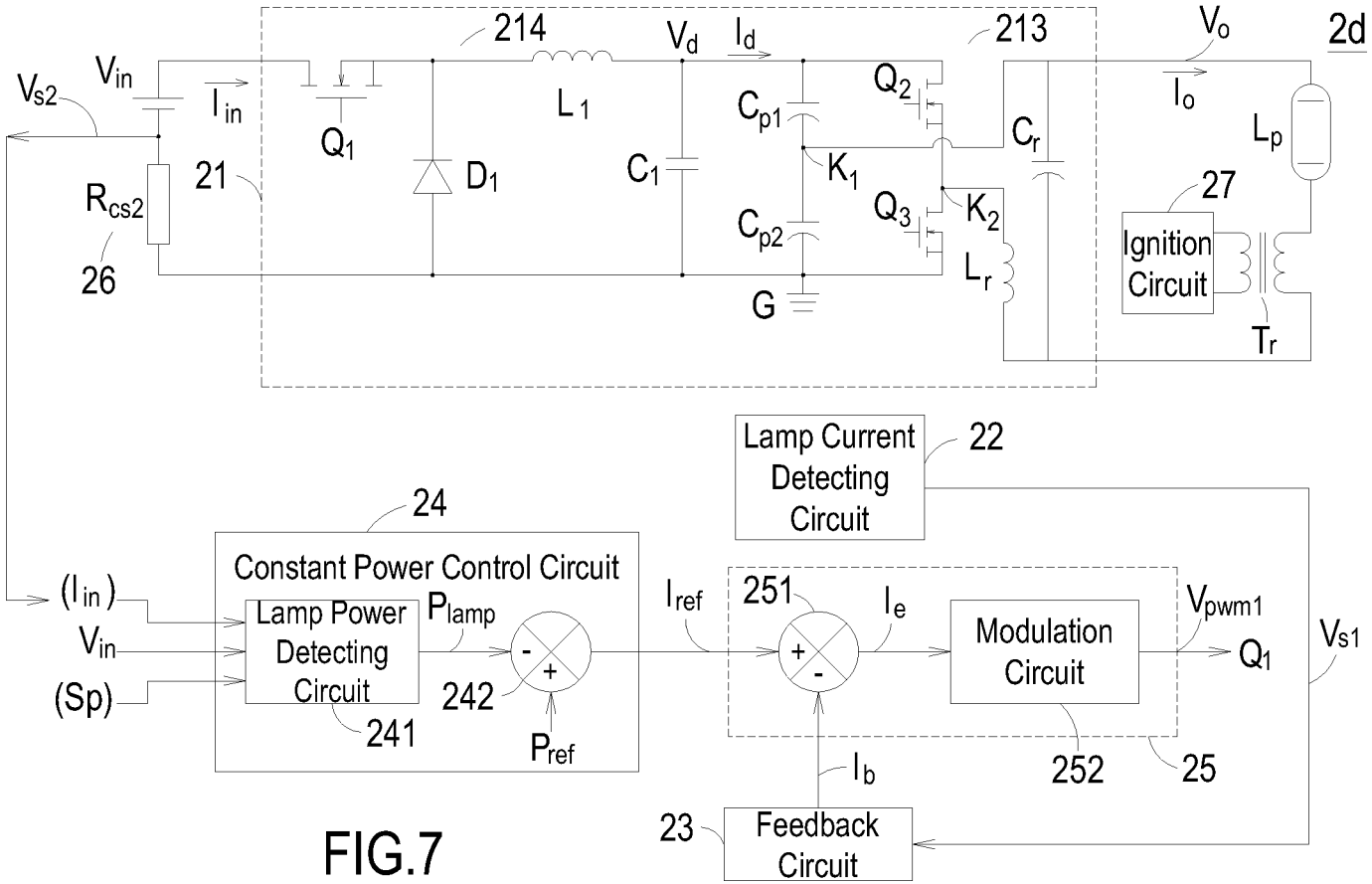
FIG. 7 shows the detailed circuitry of the driving circuit system for gas discharge lamp according to a fourth embodiment of the invention.

Referring to FIGS. 4, 6, and 7, in which FIG. 7 is a detailed circuit diagram showing the driving circuit system for gas discharge lamp according to a fourth embodiment of the invention. As shown in FIG. 7, the driving circuit system 2*d* for gas discharge lamp includes a power circuit 21, a lamp current detecting circuit 22, a feedback circuit 23, a constant power control circuit 24, and a power control circuit 25. The difference between FIG. 7 and FIG. 6 is that the input voltage Vin of FIG. 7 is a DC voltage, and the power circuit 21 of FIG. 7 includes a DC converter 214 and an inverter 213 connected in sequence with each other. The DC converter 214 of FIG. 7 is analogous to the power circuit 21 of FIG. 4, and the inverter 213 of FIG. 7 is analogous to the inverter 213 of FIG. 6. In this embodiment, the DC input voltage Vin is converted into a first DC power, e.g. a first DC voltage Vd by the DC converter 214, and then the first DC voltage Vd is converted into an AC lamp voltage Vo by the inverter 213. In this embodiment, the DC converter 214 may operate as a voltage source or a current source. For example, the first power provided for the inverter 213 provide a first DC voltage Vd with a fixed voltage value or a first DC current Id with a fixed current value.

As shown in FIG. 7, the driving circuit system 2*d* for gas discharge lamp further includes an input current detecting circuit 26, an ignition circuit 27, and an isolated transformer Tr. The input current detecting circuit 26 is connected to the input end of the DC converter 214. The connecting relationship between the ignition circuit 27 and the isolated transformer Tr is similar to that of FIG. 6. Likewise, the internal circuitry of the constant power control circuit 24 and the internal circuitry of the power control circuit 25 are similar to those of FIG. 4. Hence, it is not intended to give details for these circuit elements herein.

In this embodiment, the constant power control circuit 24 obtains the current lamp power Plamp by sampling the input voltage Vin, the input current Iin, and a signal Sp associated with the lamp voltage (such as the lamp voltage Vo or the duty ratio D of the first switch Q1). The obtained lamp power Plamp is compared with the predetermined lamp power Pref to obtain the variable current reference signal Iref. The lamp current detecting circuit 22 is connected to the power circuit 21 or the gas discharge lamp for detecting the lamp current. The lamp current detecting circuit 22 can generate the first current detecting signal Vs1 in accordance with the lamp current Io, so that the feedback circuit 23 can generate the lamp current feedback signal Ib associated with the lamp current Io in accordance with the first current detecting signal Vs1. The current error amplifier 251 of the power control circuit 25 can compare the corrected current reference signal Iref with the lamp current feedback signal Ib which is variable with the lamp current Io and generate a current error signal Ie in response to the comparison. The modulation circuit 252 can adjust the duty ratio D or the switching frequency of the first modulating signal Vpwm1 in accordance with the current error signal Ie, so that the lamp current feedback signal Ib is equal to the current reference signal Iref.

In this embodiment, the DC converter can adjust the first DC current Id of the DC converter in accordance with the status of the gas discharge lamp Lp. As the inverter 213 can convert the first DC voltage Vd into an AC lamp voltage Vo in accordance with a fixed switching frequency or a fixed duty ratio, the lamp current Io will vary with the first DC current Id. Hence, the constant power control circuit 24 can control the value of the first DC current Id to allow the value of the lamp current Io to be controlled accordingly. In other words, the constant power control circuit 24 can adjust the first DC current Id of the DC converter 214 to control the lamp power Plamp outputted from the power circuit 21 to the gas discharge lamp Lp to be substantially maintained at a constant value. The first DC voltage Vd is variable with the first DC current and the variations of the load impedance of the DC converter 214. The lamp voltage Vo is determined by the lamp current Io and the lamp impedance.

Overall, the control method carried out by the inventive driving circuit system for gas discharge lamp includes the steps of: (1) Detecting the lamp current Io and generating a first current detecting signal Vs1 associated with the lamp current Io by the lamp current detecting circuit 22, (2) Generating a lamp current feedback signal Ib in accordance with first current detecting signal Vs1 associated with the lamp current by the feedback circuit 23; (3) Generating a corrected current reference signal Iref in accordance with the status of the gas discharge lamp Lp by the constant power control circuit 24, in which the constant power control circuit 24 determines the status of the gas discharge lamp Lp by means of the input voltage Vin, the input current Iin, and a signal Sp associated with the lamp voltage (such as the lamp voltage Vo or duty ratio D of the first switch Q1) and generates the corrected current reference signal Iref in accordance with the status of the gas discharge lamp Lp; and (4) Generating the first modulating signal Vpwm1 in accordance with the lamp current feedback signal Ib and the corrected current reference signal Iref, thereby allowing the first switch Q1 of the power circuit 21 to turn on or off and maintaining the lamp power Plamp of the gas discharge lamp Lp at a constant value.

In conclusion, the inventive driving circuit system includes a constant control circuit for generating a corrected current reference signal for the power control circuit, so that the constant power control circuit can maintain the lamp power at a constant value by means of the corrected current reference signal. Hence, the current reference signal of the invention is not constant but is variable in accordance with the status of the gas discharge lamp. When the gas discharge lamp is aged, the constant power control circuit will correct the current reference signal and substantially maintain the lamp power of the gas discharge lamp at a constant value.

While the invention has been described in terms of what are presently considered to be the most practical and preferred embodiments, it is to be understood that the invention need not be restricted to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the invention which is defined by the appended claims.

What is claimed is:

1. A driving circuit system for gas discharge lamp, comprising:

a power circuit having a first switch for converting an input voltage into a lamp voltage for driving a gas discharge lamp in accordance with switching operations of the first switch;

a lamp current detecting circuit connected to the power circuit or the gas discharge lamp for detecting a lamp current of the gas discharge lamp;

a feedback circuit connected to the lamp current detecting circuit for generating a lamp current feedback signal in accordance with variations of the lamp current;

a constant power control circuit for generating a corrected current reference signal in accordance with a status of the gas discharge lamp; and a power control circuit connected to the feedback circuit, the constant power control circuit, and the first switch of the power circuit for generating a first modulating signal in accordance with the lamp current feedback signal and the corrected current reference signal for driving the first switch to turn on or off, thereby substantially maintaining a lamp power of the gas discharge lamp at a constant value.

2. The driving circuit system according to claim 1 wherein when the gas discharge lamp is aged, the constant power control circuit corrects a current reference signal to substantially maintain the lamp power of the gas discharge lamp at a constant value.

3. The driving circuit system according to claim 1 further comprising:

an ignition circuit; and an isolated transformer having a primary winding connected to the ignition circuit and a secondary winding connected to the gas discharge lamp;

wherein before the gas discharge lamp is ignited, an igniting voltage generated by the ignition circuit is transmitted to the gas discharge lamp through the isolated transformer, thereby igniting the gas discharge lamp.

4. The driving circuit system according to claim 1 wherein the constant power control circuit includes:

a lamp power detecting circuit; and a power error amplifier;

wherein the lamp power detecting circuit is configured to calculate the lamp power of the gas discharge lamp and the power error amplifier is configured to calculate an error between the lamp power calculated by the lamp power detecting circuit and a predetermined power and generate a corrected current reference signal in accordance with the error, thereby allowing the constant power control circuit to maintain the lamp power of the gas discharge lamp at a constant value in accordance with the corrected current reference signal.

5. The driving circuit system according to claim 1 wherein the power circuit is a buck converter.

6. The driving circuit system according to claim 1 wherein the power circuit includes:

a DC converter having the first switch for converting the input voltage into a first DC power by the switching operations of the first switch; and an inverter having a second switch and a third switch for converting the first DC power into the lamp voltage for driving the gas discharge lamp in accordance with the switching operations of the second switch and the third switch.

7. The driving circuit system according to claim 1 wherein the constant power control circuit is configured to calculate the lamp power in accordance with the input voltage, an input current, a duty ratio, a switching frequency, the lamp current, the lamp voltage, and/or a combination thereof, thereby determining the status of the gas discharge lamp and generating the corrected current reference signal.

8. The driving circuit system according to claim 7 further comprising an input current detecting circuit for detecting the input current to allow the constant power control circuit to obtain a current input current by the input current detecting circuit.

9. The driving circuit system according to claim 7 wherein the power control circuit includes:

a current error amplifier; and a modulation circuit;

wherein the current error amplifier is configured to compare the current reference signal with the lamp current feedback signal and in response thereto generate a current error signal, and the modulation circuit is configured to adjust the duty ratio or the switching frequency in accordance with the current error signal, thereby equaling the lamp current feedback signal and the current reference signal.

10. A driving circuit system for gas discharge lamp, comprising:

an inverter having a second switch and a third switch for converting a DC voltage into a lamp voltage for driving a gas discharge lamp in accordance with switching operations of the second switch and the third switch;

a lamp current detecting circuit connected to the inverter or the gas discharge lamp for detecting a lamp current of the gas discharge lamp;

a feedback circuit connected to the lamp current detecting circuit for generating a lamp current feedback signal in accordance with variations of the lamp current;

a constant power control circuit for generating a corrected current reference signal in accordance with a status of the gas discharge lamp;

a power control circuit for generating a second modulating signal and a third modulating signal in accordance with the lamp current feedback signal and the corrected current reference signal; and a switching driver connected to a control terminal of the second switch and a control terminal of the third switch for receiving the second modulating signal and the third modulating signal to drive the second switch and the third switch to turn on or off, thereby substantially maintaining a lamp power of the gas discharge lamp at a constant value.

11. The driving circuit system according to claim 10 wherein when the gas discharge lamp is aged, the constant power control circuit corrects a current reference signal to substantially maintain the lamp power of the gas discharge lamp at a constant value.

12. The driving circuit system according to claim 10 further comprising:

an ignition circuit; and an isolated transformer having a primary winding connected to the ignition circuit and a secondary winding connected to the gas discharge lamp;

wherein before the gas discharge lamp is ignited, an igniting voltage generated by the ignition circuit is transmitted to the gas discharge lamp through the isolated transformer, thereby igniting the gas discharge lamp.

13. The driving circuit system according to claim 10 wherein the inverter is a half-bridge circuit or a full-bridge circuit.

14. The driving circuit system according to claim 10 further comprising a rectifier for rectifying the input voltage into a rectified voltage.

15. The driving circuit system according to claim 14 further comprising a power factor correction circuit connected to the rectifier and the inverter for converting the rectified voltage into a DC voltage and correcting a power factor of the input voltage.

16. The driving circuit system according to claim 10 wherein the constant power control circuit is configured to calculate the lamp power of the gas discharge lamp in accordance with a duty ratio, a switching frequency, the DC voltage, a DC current, a signal associated with the lamp voltage, and/or a combination thereof, thereby determining a status of the gas discharge lamp and generating the corrected current reference signal.

17. The driving circuit system according to claim 16 further comprising a bus current detecting circuit for constituting a series loop with an input end of the inverter and detecting the DC current, thereby allowing the constant power control circuit to obtain the DC current by a first current detecting circuit.

18. The driving circuit system according to claim 16 wherein the constant power control circuit includes:

a digital microcontroller; and a plurality of detecting circuits;

wherein the digital microcontroller is configured to obtain the lamp current, the DC voltage, the DC current, and the duty ratio by the plurality of detecting circuits, thereby determining a status of the gas discharge lamp and outputting the corrected current reference signal to the power control circuit.

19. A control method for controlling a driving circuit system for gas discharge lamp, comprising the steps of:

(1) detecting a signal associated with a lamp current of a gas discharge lamp and in response thereto generating a first current detecting signal associated with the lamp current;

(2) generating a lamp current feedback signal in accordance with the first current detecting signal;

(3) generating a corrected current reference signal in accordance with a status of the gas discharge lamp; and (4) generating a first modulating signal in accordance with the lamp current feedback signal and the corrected current reference signal, thereby driving a first switch of a power circuit to turn on or off and substantially maintaining a lamp power of the gas discharge lamp at a constant value.

20. The control method according to claim 19 wherein the step (3) is carried out by calculating the lamp power of the gas discharge lamp in accordance with an input voltage, an input current, a duty ratio, a switching frequency, the lamp current, a lamp voltage, and/or a combination thereof, thereby determining the status of the gas discharge lamp and generating the corrected current reference signal.

* * * * *

UNITED STATES PATENT AND TRADEMARK OFFICE

CERTIFICATE OF CORRECTION

PATENT NO. : 8,564,221 B2
APPLICATION NO. : 13/242094
DATED : October 22, 2013
INVENTOR(S) : Qi Zhang, Weiqiang Zhang and Jianping Ying It is certified that error appears in the above-identified patent and that said Letters Patent is hereby corrected as shown below:

On the Title Page, Item (73), please change the Assignee information from "Delta Electronics (Shanghi) Co., Ltd., Shanghai (CN)" to read "Delta Electronics (Shanghai) Co., Ltd., Shanghai (CN)."

Signed and Sealed this
Fourth Day of February, 2014

Michelle K. Lee

Michelle K. Lee
*Deputy Director of the United States Patent and Trademark Office*